US010123124B2

(12) United States Patent
Ding et al.

(10) Patent No.: US 10,123,124 B2
(45) Date of Patent: Nov. 6, 2018

(54) MINIATURE LOUDSPEAKER

(71) Applicant: GOERTEK INC., WeiFang, Shandong (CN)

(72) Inventors: Hui Ding, WeiFang (CN); Gege Zhang, WeiFang (CN)

(73) Assignee: GOERTEK INC., WeiFang, Shandong (CN)

( * ) Notice: Subject to any disclaimer, the term of this patent is extended or adjusted under 35 U.S.C. 154(b) by 0 days.

(21) Appl. No.: 15/539,992

(22) PCT Filed: Nov. 11, 2015

(86) PCT No.: PCT/CN2015/094272
§ 371 (c)(1),
(2) Date: Jun. 26, 2017

(87) PCT Pub. No.: WO2016/101723
PCT Pub. Date: Jun. 30, 2016

(65) Prior Publication Data

US 2017/0353802 A1 Dec. 7, 2017

(30) Foreign Application Priority Data

Dec. 25, 2014 (CN) ..... 2014 1 0820436

(51) Int. Cl.
*H04R 9/02* (2006.01)
*H04R 9/06* (2006.01)
*H04R 31/00* (2006.01)

(52) U.S. Cl.
CPC ..... *H04R 9/025* (2013.01); *H04R 9/02* (2013.01); *H04R 9/06* (2013.01); *H04R 31/006* (2013.01); *H04R 2209/024* (2013.01); *H04R 2209/027* (2013.01); *H04R 2499/11* (2013.01)

(58) Field of Classification Search
CPC ..... H04R 9/06; H04R 9/025
See application file for complete search history.

(56) References Cited

FOREIGN PATENT DOCUMENTS

| | | | |
|---|---|---|---|
| CN | 203086724 | U | 7/2013 |
| CN | 203387664 | U | 1/2014 |
| CN | 103686551 | A | 3/2014 |
| CN | 203747987 | U | 7/2014 |
| CN | 203883987 | U | 10/2014 |

(Continued)

OTHER PUBLICATIONS

International Search Report dated Feb. 6, 2016 of PCT/CN2015/094272 which is the parent application and its English translation—4 pages.

*Primary Examiner* — Brian Ensey
(74) *Attorney, Agent, or Firm* — Knobbe Martens Olson & Bear LLP

(57) ABSTRACT

Disclosed is a miniature loudspeaker, comprising a magnetic circuit system which comprises a yoke, a magnet and a washer, the yoke and the magnet are fixedly bonded, the magnet and the washer are fixedly bonded, a snap-fitting portion and a limiting portion, which are mutually cooperated, are disposed on the yoke and the magnet and/or on the magnet and the washer, the limiting portion is a structure formed by removing material, the snap-fitting portion and the limiting portion are both located on bonding surfaces of two components, and the limiting portion and the snap-fitting portion are coupled and fixed.

11 Claims, 6 Drawing Sheets

(56) References Cited

FOREIGN PATENT DOCUMENTS

| | | | | | |
|---|---|---|---|---|---|
| CN | 204539459 | U | 8/2015 | | |
| KR | 20080001615 | * | 1/2008 | ..... | H04R 9/02 |
| KR | 2010042176 | * | 4/2010 | ..... | H04R 9/02 |

* cited by examiner

MINIATURE LOUDSPEAKER

TECHNICAL FIELD

The present invention relates to the electro-acoustic field, and more particularly, to a miniature loudspeaker.

BACKGROUND ART

In the structure of the miniature loudspeaker, the magnetic circuit system provides the magnetic field necessary to drive the voice coil, and the voice coil moves in the magnetic gap so as to cut magnetic field lines back and forth under the effect of the electromagnetic field when an alternating current passes through, thus motivating the mechanical vibration of the vibrating diaphragm to radiate sound wave to the air. Therefore, the performance of the magnetic circuit system directly affects the performance of miniature loudspeaker. Some miniature loudspeakers adopts a dual magnetic circuit structure, which can increase the magnetic flux in the magnetic gap and reduce magnetic flux leakage, thereby improving the sensitivity of the miniature loudspeakers.

However, in the existing miniature loudspeaker, the washer and the magnet as well as the yoke and the magnet as the components of the magnetic circuit system are bonded to each other by bonding planes, and the bonding strength is ensured by coating adhesive, and the bonding force thereof is poor, and the washer or the magnet is likely to fall off due to the poor coating of the adhesive, the mechanical shock, or the drop of the product when preparing the product, carrying the product, and using the product, and thus affecting the performance of the product and resulting in the product failure. Therefore, it is necessary to improve the fixing process between the components of the magnetic circuit system, increase the bonding strength, and reduce or even avoid the drop of the washer or the magnet.

SUMMARY

In view of the above-mentioned problems, the technical problem to be solved by the present invention is: to provide a miniature loudspeaker which improves the fixing process between the components of the magnetic circuit system of the existing miniature loudspeaker while the whole consisting of the components remains unchanged, thus enhancing the bonding strength and increasing the bonding force, so that the fixation thereof will be more solid and more stable.

In order to solve the above-mentioned problems, the technical solution of the present invention is:

a miniature loudspeaker, comprising a magnetic circuit system, wherein the magnetic circuit system comprises a yoke, and a magnet and a washer which are accommodated in the yoke; the magnet is bonded and fixed to the yoke, and the washer is bonded and fixed to the magnet, and wherein a snap-fitting portion and a limiting portion are respectively provided on the yoke and the magnet which are adjacent to each other, and/or respectively provided on the magnet and the washer which are adjacent to each other, and the snap-fitting portion and the limiting portion are matched with each other; the limiting portion is a structure formed by removing material; the snap-fitting portion and the limiting portion are located on bonding surfaces of the yoke and the magnet, and/or on bonding surfaces of the magnet and the washer; and the limiting portion and the snap-fitting portion are coupled and fixed with each other.

Wherein the magnetic circuit system has a single magnetic circuit structure or a dual magnetic circuit structure.

Wherein the magnetic circuit system has a dual magnetic circuit structure; the magnet comprises a center magnet and an edge magnet; the center magnet is bonded and fixed to a middle position of a base portion of the yoke, and the edge magnet is fixed to an edge position of the base portion of the yoke and is provided around the center magnet; and the washer comprises a center washer and an edge washer; the center washer is bonded and fixed to the center magnet, and the edge washer is bonded and fixed to the edge magnet.

Wherein the limiting portion is provided on the magnet, and the snap-fitting portion is provided on the washer; or the limiting portion is provided on the washer, and the snap-fitting portion is provided on the magnet.

Wherein the limiting portion is provided on the magnet, and the snap-fitting portion is provided on the yoke; or the limiting portion is provided on the yoke, and the snap-fitting portion is provided on the magnet.

Wherein the limiting portion is a plug-pull type slot having a stepped structure and comprises a vertical surface and a horizontal surface, and the vertical surface and the horizontal surface intersect perpendicularly; both the horizontal surface and the vertical surface are recesses formed by removing material; and a distance between two ends of the horizontal surface is larger than a distance between a left end and a right end of the vertical surface.

Wherein the snap-fitting portion is a protruding portion which is matched with the plug-pull type slot and also comprises a vertical surface and a horizontal surface which intersect perpendicularly, and the snap-fitting portion is coupled with the vertical surface and the horizontal surface of the plug-pull type slot.

Wherein the limiting portion is an inclined groove, and comprises a vertical surface and an inclined surface formed by removing material, and a length of a front straight edge of the inclined surface is different from a length of a back straight edge of the inclined surface opposite to the front straight edge, and a concave surface inclined downward is formed on one of the bonding surfaces of the yoke and the magnet, or on one of the bonding surfaces of the magnet and the washer.

Wherein the snap-fitting portion is a protruding portion which is matched with the inclined groove, and is coupled with the inclined groove.

Wherein the limiting portion is provided at a middle position or an edge position of a component of the magnetic circuit system, and the snap-fitting portion which is matched with the limiting portion is provided at a middle position or an edge position of a corresponding component.

After adopting the above the technical solution of the present invention, the advantageous effects of the present invention are:

since in the structure of the miniature loudspeaker according to the present invention, the yoke and the magnet which are adjacent to each other are provided with the limiting portion and the snap-fitting portion which are matched with each other, and/or the magnet and the washer which are adjacent to each other are provided with the limiting portion and the snap-fitting portion which are matched with each other, and both the limiting portion and the snap-fitting portion are located on the bonding surfaces of the two structures which are adjacent to each other, and the limiting portion and the snap-fitting portion are coupled and fixed with each other, and in this way, the contact area between the yoke and the magnet and/or between the magnet and the washer may be enlarged, therefore, on the basis of this structure, when the adhesive is coated, the bonding force thereof is stronger, and the fixation is more solid and more stable. The yoke, the magnet, and the washer which are components of the magnetic circuit system are not easy to fall off during the preparation and the usage of the miniature loudspeaker product, thus better ensuring the performance of the miniature loudspeaker.

Since in the present invention, the magnetic circuit system of the miniature loudspeaker has a single magnetic circuit structure or a dual magnetic circuit structure, and the limiting portion and the snap-fitting portion can be provided not only on the yoke, the magnet and the washer of the single magnetic circuit, but also between the components of the center magnetic circuit system and the edge magnetic circuit system of the dual magnetic circuit structure, and when such a positioning structure is added to the bonding surfaces of two adjacent structures, the bonding strength is increased, and the contact area is enlarged, and for the miniature loudspeaker having the dual magnetic circuit structure, the falling off of the edge magnet and the edge washer thereof can be also avoided, thus ensuring that the edge magnetic circuit and the center magnetic circuit thereof are stable and reliable.

Due to the miniature loudspeaker of the present invention, the limiting portion on the yoke or the magnet, and/or the magnet or the washer which are adjacent to each other may be a plug-pull type slot, or may be an inclined groove, and the snap-fitting portion which is matched with the limiting portion is easier to be fixed and coupled with the limiting portion for ease of operation and positioning, and compared with other positioning structure, the plug-pull type slot structure and the inclined structure is more likely to increase the contact area, thus making the positioning more stable.

In view of the above, the miniature loudspeaker of the present invention can reduce or even avoid the phenomenon that the magnet and the washer are easy to fall off due to the poor bonding force in the prior art, improve the firmness of the bonding between the yoke and the magnet, as well as the magnet and the washer, and improve the stability of the magnetic circuit systems of the loudspeaker having the single magnetic circuit structure and the loudspeaker having the dual magnetic circuit structure, thus ensuring the performance of miniature loudspeaker product and improving the yield rate of the product.

Figure 1:
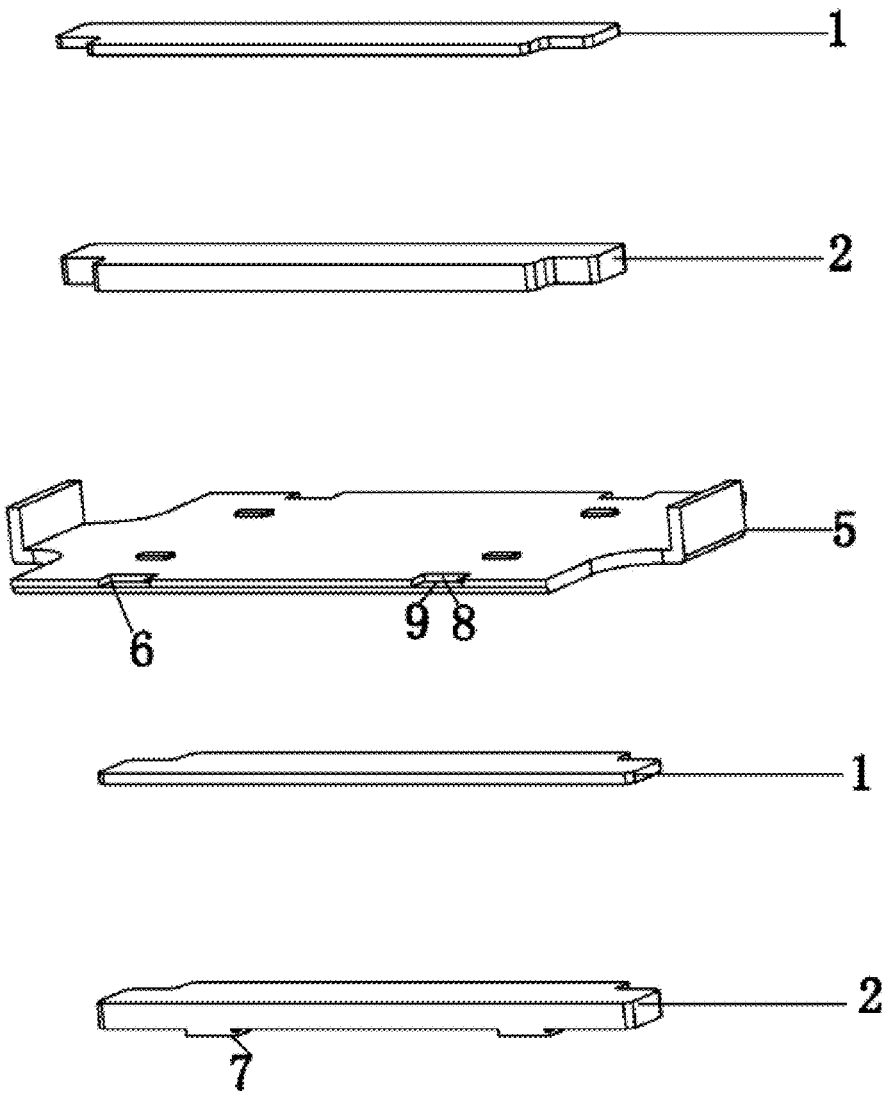
FIG. 1 is an exploded schematic view of the plug-pull type slot position structure of the edge magnet according to the first embodiment of the present invention.

Wherein reference numerals comprise: 1. edge washer, 2. edge magnet, 3. center washer, 4. center magnet, 5. yoke, 6. limiting portion, 6'. limiting portion, 7. snap-fitting portion, 7'. snap-fitting portion, 8. vertical surface, 8'. vertical surface, 9. horizontal surface, 9'. inclined surface.

DETAILED DESCRIPTION OF EMBODIMENTS

The present invention will be further described below with reference to the drawings and the embodiments.

Figure 2:
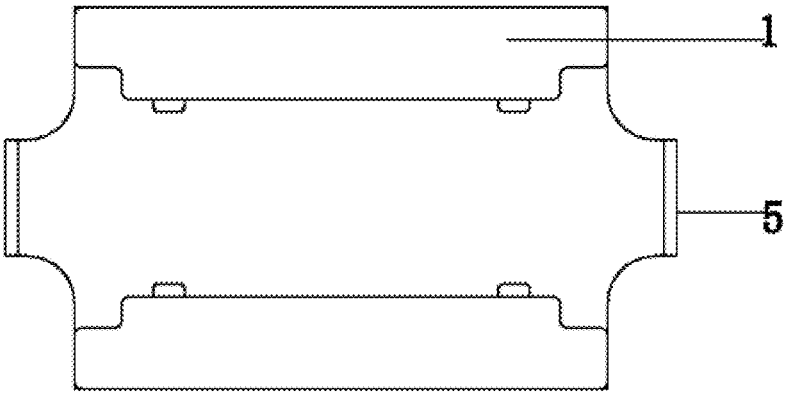
FIG. 2 is a front view of the magnetic circuit system according to the first embodiment of the present invention.
Figure 3:
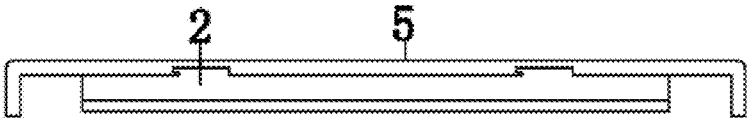
FIG. 3 is a top view of the magnetic circuit system according to the first embodiment of the present invention.
Figure 4:
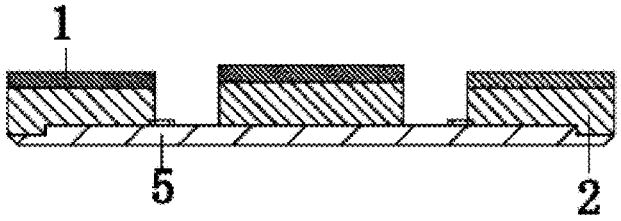
FIG. 4 is a cross-sectional view of the magnetic circuit system according to the first embodiment of the present invention.

The First Embodiment:

As jointly shown in FIGS. 1 to 4, the present embodiment relates to an edge magnetic circuit system of a miniature loudspeaker having a dual magnetic circuit structure, and the magnetic circuit system comprises a yoke 5, and an edge magnet 2 and an edge washer 1 accommodated in the yoke 5. As jointly shown in FIG. 1 and FIG. 3, the yoke 5 and the edge magnet 2, which are adjacent to each other, are provided with a limiting portion 6 and a snap-fitting portion 7, respectively, and the limiting portion 6 is a structure formed by removing material. The limiting portion 6 and the snap-fitting portion 7 are located on the bonding surfaces of the yoke 5 and the edge magnet 2, and the limiting portion 6 and the snap-fitting portion 7 are coupled and fixed with each other, so as to position the edge magnet 2.

Preferably, the limiting portion 6 has a plug-pull type slot structure, and has a stepped structure, and comprises a vertical surface 8 and a horizontal surface 9, and the two surfaces intersect perpendicularly; the vertical surface 8 and the horizontal surface 9 are recesses formed by removing material; the distance between the two ends of the horizontal surface 9 is larger than the distance between the left end and the right end of the vertical surface 8. Correspondingly, the snap-fitting portion 7 is a protruding portion which is matched with the limiting portion 6 and also comprises a vertical surface and a horizontal surface, and the vertical surface and the horizontal surface intersect perpendicularly and are coupled with the vertical surface 8 and the horizontal surface 9 of the limiting portion 6, respectively.

According to the above-described technical solution, the yoke 5 and the edge magnet 2, which are adjacent to each other, are provided with a limiting portion 6 and a snap-fitting portion 7, respectively, and both the limiting portion 6 and the snap-fitting portion 7 are located on the bonding surfaces of the yoke 5 and the edge magnet 2, and in this way, the contact area between the yoke 5 and the edge magnet 2 can be increased, and when the fixing is performed by coating an adhesive, the bonding force thereof will be stronger, and the fixation of the yoke 5 and the edge magnet 2 will be more stable, such that the edge magnet is not easy to fall off when a product is being manufactured, being carried and being used, thus better ensuring the stability of the dual magnetic circuit system and improving the performance of the product.

In the present embodiment, the limiting portion 6 and the snap-fitting portion 7 are located at the edge positions of the yoke 5 and the edge magnet 2. In practice, the limiting portion 6 and the snap-fitting portion 7 are not limited to dispose at the edge positions, and can also be disposed at the middle positions of the yoke 5 and the edge magnet 2. When the limiting portion 6 and the snap-fitting portion 7 are disposed at the edge positions of the bonding surfaces of the yoke 5 and the edge magnet 2, it will be more convenient to operate and implement; when the limiting portion 6 and the snap-fitting portion 7 are disposed at the middle positions of the bonding surfaces of the yoke 5 and the edge magnet 2, it will be more beneficial to the fixation of the yoke 5 and the edge magnet 2, and thus the positioning thereof may be more accurate, and the yoke 5 and the edge magnet 2 are hard to be loose and skew.

In the present embodiment, the limiting portion 6 is provided on the yoke 5, and the snap-fitting portion is provided on the edge magnet 2. In practice, the limiting portion may be provided on the edge magnet 2, and correspondingly, the snap-fitting portion may be provided on the yoke 5.

Figure 5:
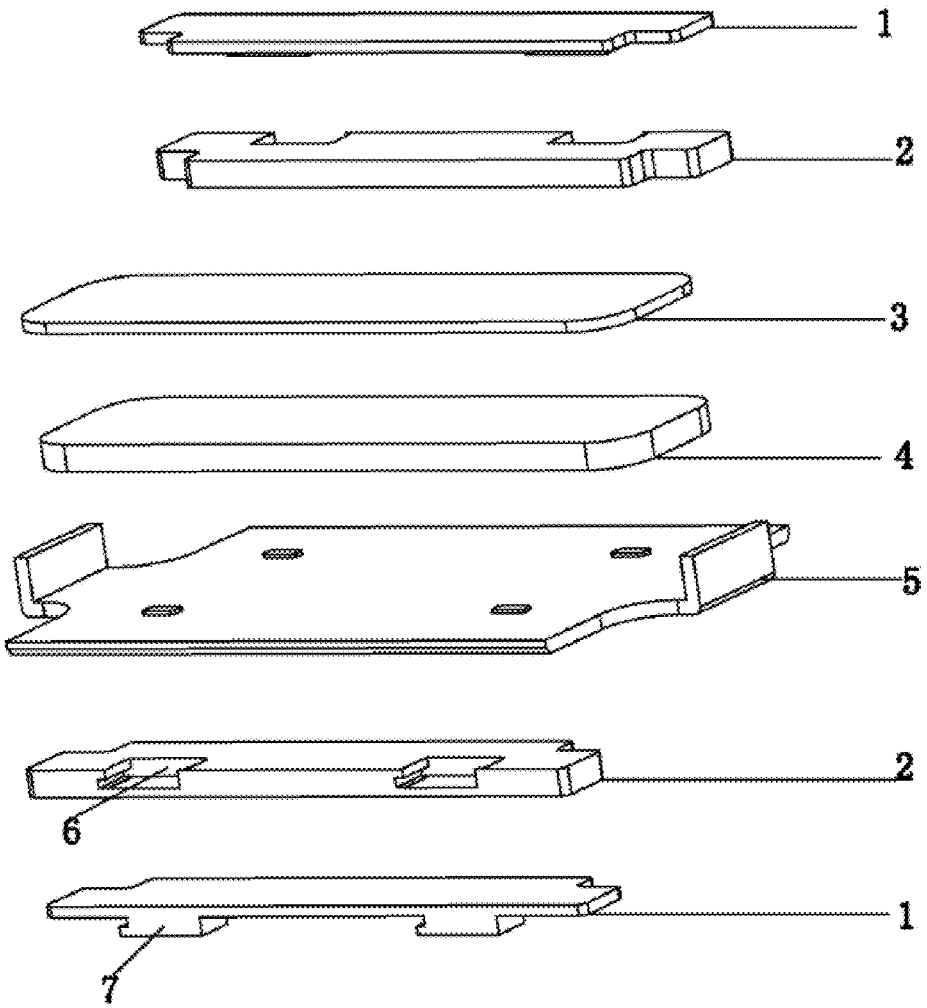
FIG. 5 is an exploded schematic view of the plug-pull type slot position structure of the edge washer according to the second embodiment of the present invention.
Figure 6:
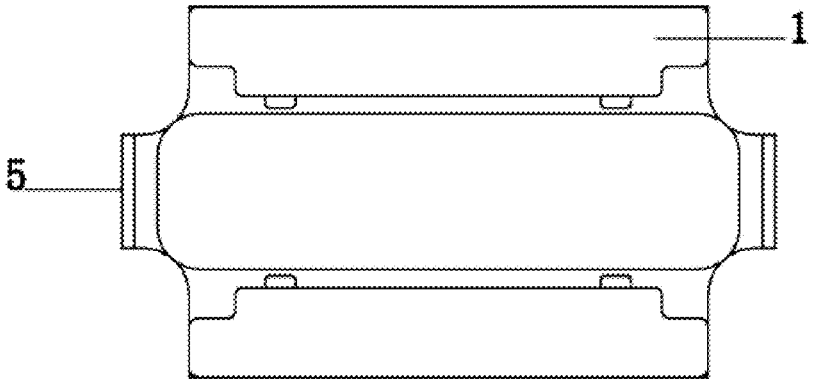
FIG. 6 is a front view of the magnetic circuit system according to the second embodiment of the present invention.
Figure 7:
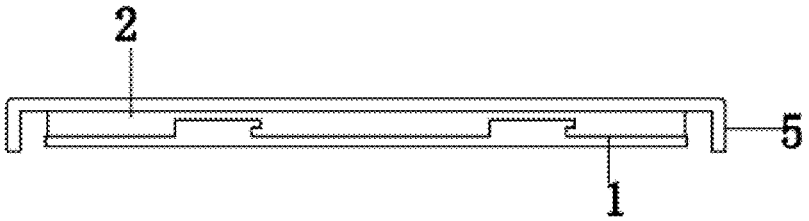
FIG. 7 is a top view of the magnetic circuit system according to the second embodiment of the present invention.
Figure 8:
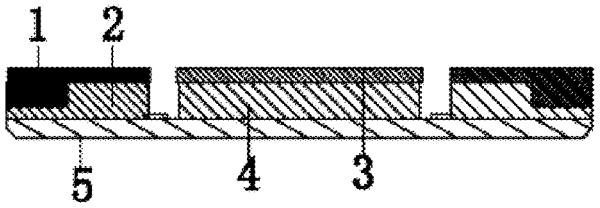
FIG. 8 is a cross-sectional view of the magnetic circuit system according to the second embodiment of the present invention.

The Second Embodiment:

As jointly shown in FIGS. 5 to 8, the present embodiment relates to a miniature loudspeaker having a dual magnetic circuit structure, and the miniature loudspeaker comprises a yoke 5, and a magnet and a washer accommodated in the yoke 5, and the magnet comprises a center magnet 4 and an edge magnet 2; the center magnet 4 is bonded and fixed to the middle position of the base portion of yoke 5, and the edge magnet 2 is fixed to the edge position of the base portion of the yoke 5 and is provided around the center magnet 4; and the washer comprises a center washer 3 and an edge washer 1; the center washer 3 is bonded and fixed to the center magnet 4, and the edge washer 1 is bonded and fixed to the edge magnet 2. The yoke 5, the center magnet 5 and the center washer 3 constitute a center magnetic circuit system; and the yoke 5, the edge magnet 2 and the edge washer 1 constitute an edge magnetic circuit system.

The present embodiment is basically the same as that of the first embodiment, and the difference between the present embodiment and the first embodiment is that:

the limiting portion 6 is provided at the edge magnet 2, and the snap-fitting portion 7 is provided on the edge washer 1 which is bonded and fixed to the edge magnet 2, and the limiting portion 6 and the snap-fitting portion 7 are used for positioning the edge washer 1.

In the present embodiment, the limiting portion 6 and the snap-fitting portion 7 are provided at the edge positions of the edge magnet 2 and the edge washer 1, respectively, but in practice, the limiting portion 6 and the snap-fitting portion 7 can also be provided at the middle positions of the bonding surfaces of the edge magnet 2 and the edge washer 1, respectively. In addition, the limiting portion 6 may be provided on the edge washer 1, and correspondingly, the snap-fitting portion may be provided on the edge magnet 2.

Figure 9:
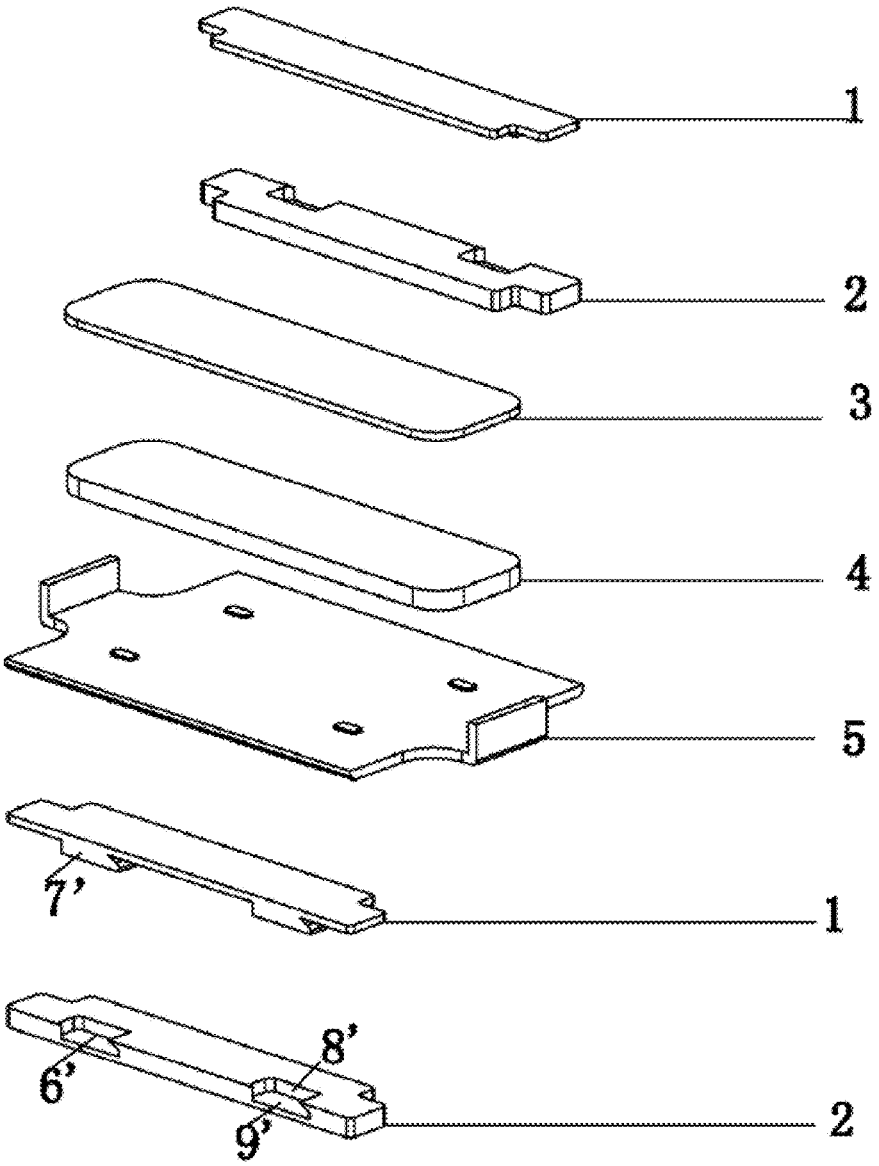
FIG. 9 is an exploded schematic view of the inclined position structure of the edge washer according to the third embodiment of the present invention.
Figure 10:
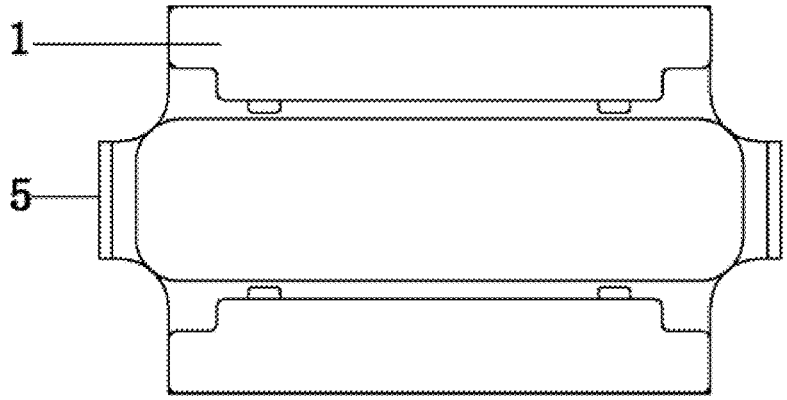
FIG. 10 is a front view of the magnetic circuit system according to the third embodiment of the present invention.
Figure 11:
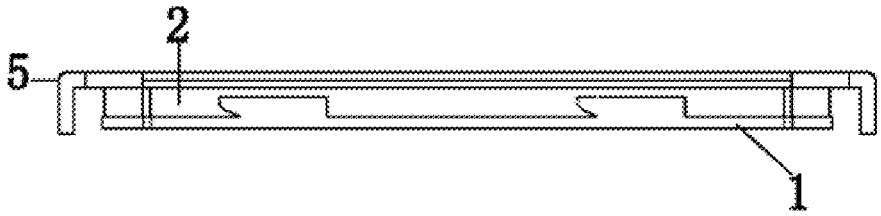
FIG. 11 is a top view of the magnetic circuit system according to the third embodiment of the present invention.
Figure 12:
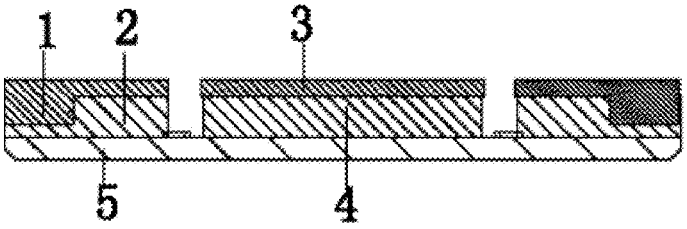
FIG. 12 is a cross-sectional view of the magnetic circuit system according to the third embodiment of the present invention.

The Third Embodiment:

As jointly shown in FIGS. 9 to 12, the present embodiment is basically the same as that of the second embodiment, and the difference between the present embodiment and the second embodiment is that:

The limiting portion 6' is an inclined groove, comprising the vertical surface 8' and the inclined surface 9' formed by removing material, and the lengths of the front straight edge and the back straight edge of the inclined surface 9' opposite to each other are different, the concave surface inclined downward is formed on one of the bonding surfaces of the edge magnet 2 and the edge washer 1. Correspondingly, the snap-fitting portion 7' is a protruding portion which is matched with the limiting portion 6, and is coupled with the inclined groove.

Similarly, in the present embodiment, the limiting portion 6' and the snap-fitting portion 7' are provided at the edge positions of the edge magnet 2 and the edge washer 1, but in practice, the limiting portion 6' and the snap-fitting portion 7' can also be provided at the middle positions of the bonding surfaces of the edge magnet 2 and the edge washer 1, respectively. In addition, the limiting portion 6' may be provided on the edge washer 1, and the snap-fitting portion 7' may be provided on the edge magnet 2.

It should be noted that, for a miniature loudspeaker having a dual magnetic circuit structure, the limiting portion may be provided on the center magnet, and the snap-fitting portion may be provided on the yoke correspondingly; or the limiting portion may be provided on the yoke, and the snap-fitting portion may be provided on the edge magnet correspondingly; and furthermore, the limiting portion may be provided on the center washer, and the snap-fitting portion may be provided on the center magnet correspondingly; or the limiting portion may be provided on the center magnet, and the snap-fitting portion may be provided on the center washer, so as to ensure the bonding strength between the components of the center magnetic circuit system, so that the bonding of the components may be more stronger.

In practice, the yoke may be provided with either a limiting portion or a snap-fitting portion, and the magnet which is adjacent to the yoke may be provided with either a snap-fitting portion or a limiting portion; similarly, the magnet may be provided with either a limiting portion or a snap-fitting portion, and the washer which is adjacent to the magnet may be provided with either a snap-fitting portion or a limiting portion; and furthermore, the limiting portion and the snap-fitting portion are not limited to provide between the yoke and the magnet, or between the magnet and the washer, and the limiting portion and the snap-fitting portion are can also be provided on both the bonding surfaces of the yoke and the magnet and the bonding surfaces of the magnet and the washer, such that the contact area of the components are further increased so as to improve the bonding strength.

In addition, the number of the limiting portions and the number of the snap-fitting portions in the miniature loudspeaker according to the present invention are not limited to one, and two or more limiting portions and snap-fitting portions may be provided at the same time, and the limiting portions and the snap-fitting portions may be provided at middle positions or edge positions of the components of the magnetic circuit system, or provided at middle positions and edge positions at the same time.

The above are only embodiments of the present invention, and are not intended to limit the present invention, and the equivalents or modifications made by those skilled in the art based on the above content disclosed by the present invention should be all incorporated into the protection scope of the appended claims.

The invention claimed is:

1. A miniature loudspeaker, comprising a magnetic circuit system, wherein the magnetic circuit system comprises a yoke, and a magnet and a washer which are accommodated in the yoke; the magnet is bonded and fixed to the yoke, and the washer is bonded and fixed to the magnet, wherein a snap-fitting portion and a limiting portion are respectively provided on the yoke and the magnet which are adjacent to each other, and/or respectively provided on the magnet and the washer which are adjacent to each other, and wherein the snap-fitting portion and the limiting portion are matched with each other; the snap-fitting portion and the limiting portion are located on bonding surfaces of the yoke and the magnet, and/or on bonding surfaces of the magnet and the washer; and the limiting portion and the snap-fitting portion are coupled and fixed with each other, wherein the limiting portion is provided at an edge position of a first component of the magnetic circuit system, and the snap-fitting portion is provided at an edge position of a second component corresponding to the first component, wherein a bottom surface of the limiting portion is wider than a top surface of the limiting portion.

2. The miniature loudspeaker according to claim 1, wherein the magnetic circuit system has a single magnetic circuit structure or a dual magnetic circuit structure.

3. The miniature loudspeaker according to claim 1, wherein the magnetic circuit system has a dual magnetic circuit structure; the magnet comprises a center magnet and an edge magnet; the center magnet is bonded and fixed to a middle position of a base portion of the yoke, and the edge magnet is fixed to an edge position of the base portion of the yoke and is provided around the center magnet; the washer comprises a center washer and an edge washer; and the center washer is bonded and fixed to the center magnet, and the edge washer is bonded and fixed to the edge magnet.

4. The miniature loudspeaker according to claim 1, wherein the limiting portion is provided on the magnet, and the snap-fitting portion is provided on the washer; or the limiting portion is provided on the washer, and the snap-fitting portion is provided on the magnet.

5. The miniature loudspeaker according to claim 1, wherein the limiting portion is provided on the magnet, and the snap-fitting portion is provided on the yoke; or the limiting portion is provided on the yoke, and the snap-fitting portion is provided on the magnet.

6. The miniature loudspeaker according to claim 1, wherein the limiting portion is a plug-pull type slot having a stepped structure and comprises a vertical surface and a horizontal surface, and the vertical surface and the horizontal surface intersect perpendicularly; and a distance between two ends of the horizontal surface is larger than a distance between a left end and a right end of the vertical surface.

7. The miniature loudspeaker according to claim 6, wherein the snap-fitting portion is a protruding portion which is matched with the plug-pull type slot and also comprises a vertical surface and a horizontal surface which intersect perpendicularly, and the snap-fitting portion is coupled with the vertical surface and the horizontal surface of the plug-pull type slot.

8. The miniature loudspeaker according to claim 1, wherein the limiting portion is an inclined groove and comprises a vertical surface and an inclined surface, and a length of a front straight edge of the inclined surface is different from a length of a back straight edge of the inclined surface opposite to the front straight edge, and a concave surface inclined downward is formed on one of the bonding surfaces of the yoke and the magnet, or on one of the bonding surfaces of the magnet and the washer.

9. The miniature loudspeaker according to claim 8, wherein the snap-fitting portion is a protruding portion which is matched with the inclined groove, and is coupled with the inclined groove.

10. The miniature loudspeaker according to claim 1, wherein the limiting portion is a structure formed by removing material.

11. The miniature loudspeaker according to claim 1, wherein the limiting portion of the first component comprises a first sidewall and a second sidewall opposing the first side wall for receiving the snap-fitting portion of the second component between the first and second sidewalls, wherein the first sidewall of the limiting portion comprises a projection and a groove that is formed under the projection, and the snap-fitting portion comprises a projection that is configured to engage with the groove when the snap-fitting portion is received between the first and second sidewalls.

* * * * *